United States Patent [19]

Vander Park

[11] Patent Number: 4,838,177

[45] Date of Patent: Jun. 13, 1989

[54] BEAM-TYPE WORK STATION SYSTEM

[75] Inventor: Antonius A. Vander Park, Oakville, Canada

[73] Assignee: Nova-Link Limited, Ontario, Canada

[21] Appl. No.: 43,892

[22] Filed: Apr. 29, 1987

[30] Foreign Application Priority Data

Nov. 14, 1986 [CA] Canada ..... 523031

[51] Int. Cl.[4] ..... A47B 3/06

[52] U.S. Cl. ..... 108/155; 108/50; 312/195

[58] Field of Search ..... 108/155, 37, 38, 50, 108/111, 64, 107, 152, 108, 109; 312/195, 196, 256, 253, 254; 248/1 A-1 J

[56] References Cited

U.S. PATENT DOCUMENTS

| | | | |
|---|---|---|---|
| 540,435 | 6/1895 | Godfrey | 108/109 |
| 1,797,717 | 3/1931 | Coates | 108/155 |
| 2,499,668 | 3/1950 | Morgan et al. | 108/155 |
| 2,787,382 | 4/1957 | Williams | 108/64 X |
| 3,093,094 | 5/1963 | Oztekin | 248/242 |
| 3,361,508 | 1/1968 | Chassevent | 312/239 |
| 3,786,765 | 1/1974 | Burr | 108/60 |
| 3,794,397 | 2/1974 | Flototto | 312/231 |
| 3,827,377 | 8/1974 | Aughtry, Jr. | 108/108 |
| 3,865,502 | 2/1975 | Bracy et al. | 312/195 X |
| 4,050,752 | 9/1977 | Dykstra | 312/195 X |
| 4,080,022 | 3/1978 | Canfield et al. | 312/239 |
| 4,113,331 | 9/1978 | Derdzinski et al. | 312/198 |
| 4,312,086 | 1/1982 | Bianco | 5/2 R |
| 4,365,561 | 12/1982 | Tellier et al. | 108/7 |
| 4,378,727 | 4/1983 | Doss | 98/33 |
| 4,428,631 | 1/1984 | Cope et al. | 312/194 |
| 4,437,411 | 3/1984 | Maxwell | 108/1 |
| 4,515,086 | 5/1985 | Kwiecinski et al. | 108/96 |
| 4,535,703 | 8/1985 | Henriott et al. | 108/50 |
| 4,550,666 | 11/1985 | Svoboda | 108/96 |
| 4,567,835 | 2/1986 | Reese et al. | 108/7 |
| 4,603,925 | 8/1986 | Cuevas-Cumming | 312/196 |
| 4,612,863 | 9/1986 | Von Hausen et al. | 108/50 X |
| 4,632,040 | 12/1986 | Sheffer | 312/195 X |

FOREIGN PATENT DOCUMENTS

| | | | |
|---|---|---|---|
| 0179410 | 10/1985 | European Pat. Off. . | |
| 751136 | 6/1956 | United Kingdom | 52/3 |

OTHER PUBLICATIONS

Burdick Group Office Furniture Catalogue published in 1983 by Herman Miller Inc.

Kinetics Power Beam Catalogue published by Kinetics Furniture 1986.

Race System Planning Guide published by Sunar.

Race System Catalogue published by Sunar (Blue Cover).

Showcase by Kinetics Furniture (Black Cover).

*Primary Examiner*—Kenneth J. Dorner

*Assistant Examiner*—José V. Chen

*Attorney, Agent, or Firm*—Panitch Schwarze Jacobs and Nadel

[57] ABSTRACT

A work station suitable for mounting electrical and/or communication equipment including a straight, elongate hollow support beam of rectangular cross-section. Hollow support legs mount the beam in a horizontal position above a floor. Support brackets are detachably connected to one or both sides of the beam and these brackets include vertical leg portions that are bolted to the side of the beam and further arm portions that extend outwardly and upwardly. Rigid work surfaces are mounted on outer sections of the outwardly and upwardly extending arm portions. The work surfaces are positioned horizontally away from and above the top of the support beam. A housing can be provided to mount display and key pad equipment on the beam side of the work surface so that a lower portion of the display and key pad equipment is positioned below a horizontal plane defined by the top of the work surface. The housing permits a variety of equipment to be held, which equipment may have delicate exposed wiring and so support mechanism of its own.

20 Claims, 17 Drawing Sheets

40
44
55
51
52
46
36
38
50
54
48
53

153
20
152
151
162
166
168
150

174
192
70
28
34
186

FIG.6a
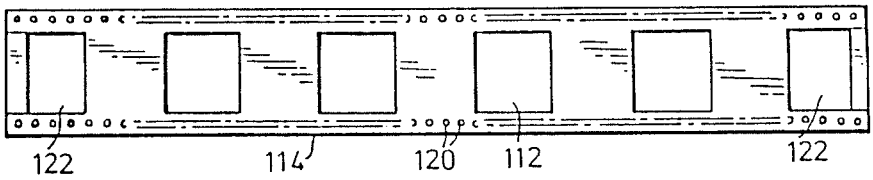
FIG.6b
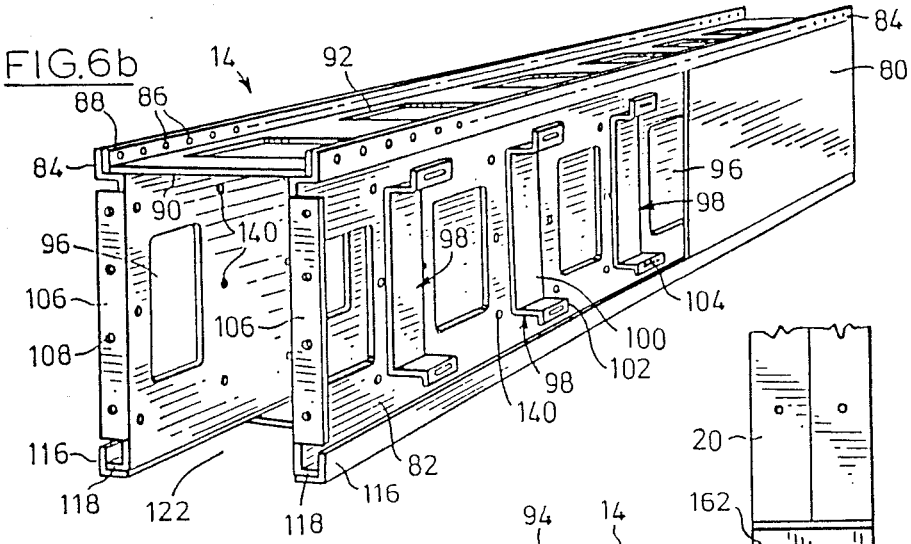
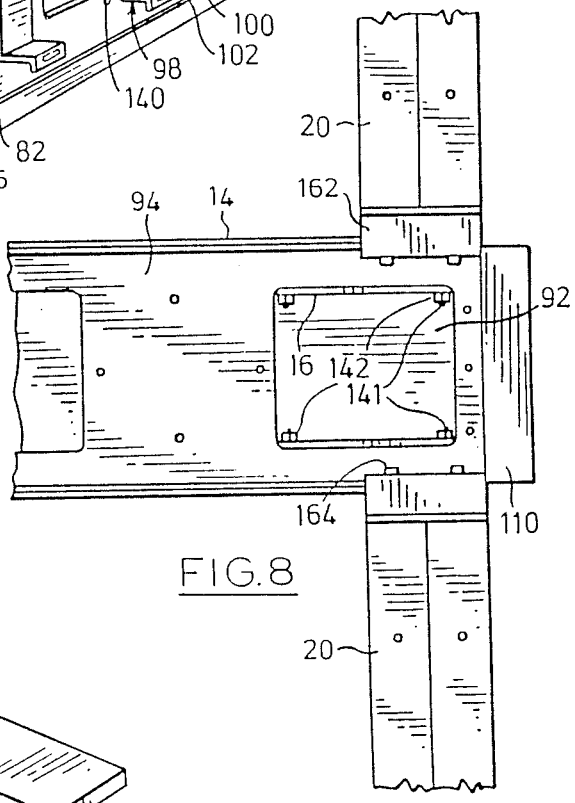
FIG.8
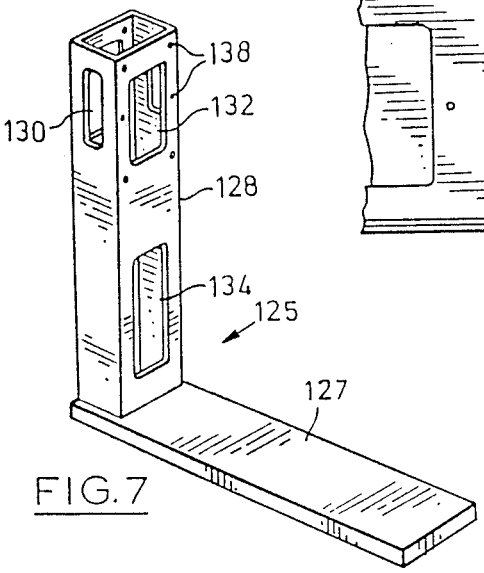
FIG.7

FIG. 23
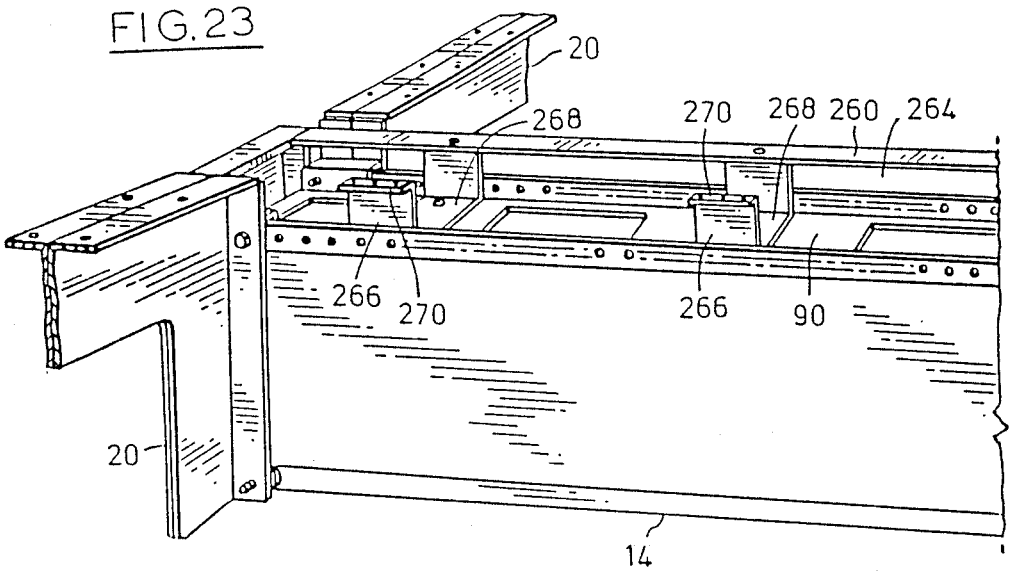
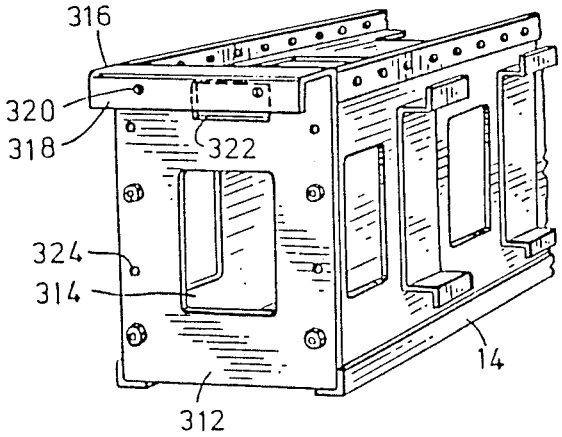
FIG. 24

BEAM-TYPE WORK STATION SYSTEM

BACKGROUND OF THE INVENTION

This invention relates to desks and work stations and, in particular, to work stations suitable for mounting electrical and/or communication equipment such as computer monitors and telephone turrets.

A variety of desks suitable for an office environment are known and such desks are made from various materials including metal, wood and suitable plastics. It is also known to construct office furniture in a modular fashion that permits a wide variety of furniture groupings or arrangements. Thus, with a relatively few basic components, it becomes possible to provide a furniture arrangement that is particularly suited for an individual customer's needs.

With the advent of the "electronic" office and the more extensive use of data supply monitors, personal computers, communication key pads, microphone and speaker systems, a need for furniture that is particularly suited for supporting and holding such equipment has developed. If a lot of electrical and electronic equipment are required together with communication equipment in a relatively small space, it becomes essential to route the necessary wiring and cables in an efficient manner and by a method that does not detract from the appearance of the office or hamper a service person from installing additional equipment or conducting repairs. Wiring and cables should be located away from floor areas where persons might trip on them as they walk by, and cables should be managed and separated so as to reduce system distortions.

The use of a support beam which not only can be used to support work surfaces in an office but also can be used as a wiring and cable conduit is known in the art. Such a system is sold under the trade name "Race System" by Sunar of Waterloo, Ontario. This system has a large horizontal beam divided into upper and lower portions. From the rigid lower portion can be supported a set of drawers or a work surface. The upper portion of the beam forms a double raceway with one of the raceways being used for communication wiring and a lower raceway being used for electrical wiring. The beam must be supported at its ends by universal posts that extend to the top of the upper portion of the beam and that have feet to maintain them upright. This known system has several disadvantages including the fact that it does not come with any special housing or support for a computer monitor, display screen or key pad touch devices. If one simply rested a computer monitor on one of the work surfaces of this system, the monitor would be quite high and it would not be easy for a person sitting at the work station to see over the monitor. This problem becomes particularly acute if it is desired to arrange a number of monitors in side-by-side fashion along the support beam.

Another difficulty with the Race System is that a leg must always be positioned at the end of the beam and this may not be possible or desirable for some applications. Also, because of the need to place a leg at the end of each beam, it may be necessary to place a leg at a location that is inconvenient or that may obstruct the legs of an office worker. The system also requires a separate steel sleeve to run wiring or cable from the floor up to the bottom of the beam. Furthermore, access to the beam's two raceway system is difficult when equipment components have been placed on or before the beam.

Another office system that uses a beam type construction is that sold under the trade mark Burdick Group by Herman Miller, Inc., of Zeeland, Mich. The beam employed is relatively small and X-shaped in cross-section. Brackets can suspend components such as storage and filing cases below the beam or cantilever them to the side of the beam. However, heavy components must be balanced equally on either side of the beam above or below by means of connecting brackets. Because the brackets can be attached at any location along the beam, components can be placed where desired or easily relocated. Some further difficulties with this known system include the need for separate wire managers, retainers and covers for electrical and communication wires. In addition, the space provided along the beam for cables is insufficient for many applications. In addition, the beam is not sufficiently large and strong enough to support a sizeable work surface on one side only or to support this work surface at a distance away from the beam. A continuous electronic equipment housing is not available with this system.

A modular console enclosure that does not employ a beam for support purposes is taught in U.S. Pat. No. 4,113,331 issued Sept. 12, 1978, to Motorola Inc. Writing surfaces or work areas are provided at the front of the unit and are cantilevered from a V-shaped structural member. The equipment housings can either be high profile or low profile. A control panel can be mounted at an angle in the console by means of heavy brackets mounted on the inner sides of two wedge-shaped structural members. The angled mounting shown in this reference has the advantage of permitting the enclosure to accommodate one or more pieces of apparatus having a total front-to-back dimension greater than the depth of the enclosure. In addition, this apparatus is displayed at a desired angle of presentation to the operator. Such systems are believed to be less flexible and more expensive than a modular beam type system.

It is an object of the present invention to provide work stations that can be made at a reasonable cost and that are highly flexible so that the same components can be used to construct a variety of work station arrangements. The preferred work stations disclosed herein have ample accommodation for electrical and communication wiring and easy access to such wiring for maintenance or installation personnel.

SUMMARY OF THE INVENTION

According to one aspect of the present invention, a work station suitable for mounting electrical and/or communication equipment comprises a straight, elongate hollow support beam adapted to extend horizontally in use and suitable as a passageway for segregated wiring. Support legs mount the beam in a horizontal position above a floor. Support brackets are detachably connected to at least one side of the beam and these brackets include arm portions that extend outwardly and upwardly. Work surfaces are mounted on outer sections of the aforementioned arm portions and these work surfaces are positioned horizontally away from and above the top of the support beam. Means for mounting the equipment on the beam side of the work surfaces are provided so that a lower portion of the equipment is positioned below a horizontal plane defined by the top of the work surfaces.

According to another aspect of the present invention, a work station suitable for mounting electrical and/or communication equipment includes a relatively large, straight, hollow support beam of sufficient strength to support work surfaces on either or both sides thereof in cantilever fashion. Support legs mount the beam in a horizontal position above a floor and support brackets are detachably connected to at least one side of the beam. Horizontal work surfaces are mounted on outer sections of the support arms and are supported in cantilever fashion thereby. There are provided means for mounting the equipment on the beam side of the work surface means and on inner sections of the support brackets. The top of the support beam mounted on the support legs is no more than about two feet above the floor and is substantially below the horizontal plane defined by the top of the work surfaces. According to a further aspect of the invention, a work station suitable for mounting electrical and/or communication equipment includes a straight, elongate support beam. Support legs mount the beam in a horizontal position above a floor while support brackets are connected to the beam and extend outwardly from at least one side thereof. Equipment housing means are mounted on the support brackets and include a housing member having a top panel, a rear panel and a bottom panel, and removable end walls. The housing member further includes means for attaching a similar housing member to one end thereof after removal of one of said end walls from the first mentioned housing member.

According to a still further aspect of the invention, a work station suitable for mounting electrical and/or communication equipment includes a straight, elongate, hollow support beam of generally rectangular cross-section and hollow support legs for mounting the beam in a horizontal position above a floor. The beam has a number of openings in the bottom thereof for insertion of top end portions of the legs into the beam for the support thereof. There are provided means for detachably connecting the top end portions to the beam upon insertion and means for mounting the equipment on the support beam.

According to another aspect of the invention, a work station suitable for mounting electrical and/or communication equipment comprises a straight, elongate hollow support beam, a tray section formed on the top of the beam for carrying wiring and/or cables and support legs for mounting the beam in a horizontal position above a floor. The beam has openings in the bottom thereof for insertion of top end portions of the legs into the beam for the support thereof, whereby the top ends of the legs after insertion are below the tray section. There are also means for mounting the equipment on the support beam.

Further features and advantages will become apparent from the following detailed description taken in conjunction with the accompanying drawings.

BRIEF DESCRIPTION OF THE DRAWINGS

FIG. 6*a* is a bottom view of a support beam used in the work stations;

FIG. 6*b* is a perspective view of the hollow support beam of FIG. 6*a*;

FIG. 7 is a perspective view of a support leg that can be used to mount the beam of FIG. 6*a* and 6*b* in a horizontal position;

FIG. 8 is a detailed view illustrating how a top end portion of a support leg is connected to the end of a support beam;

FIG. 23 is a detail perspective view showing the use of brackets on top of the beam; and FIG. 24 is a perspective view of the end of a support beam fitted with a 90 degree junction bracket.

DETAILED DESCRIPTION OF PREFERRED EMBODIMENTS

Figure 1:
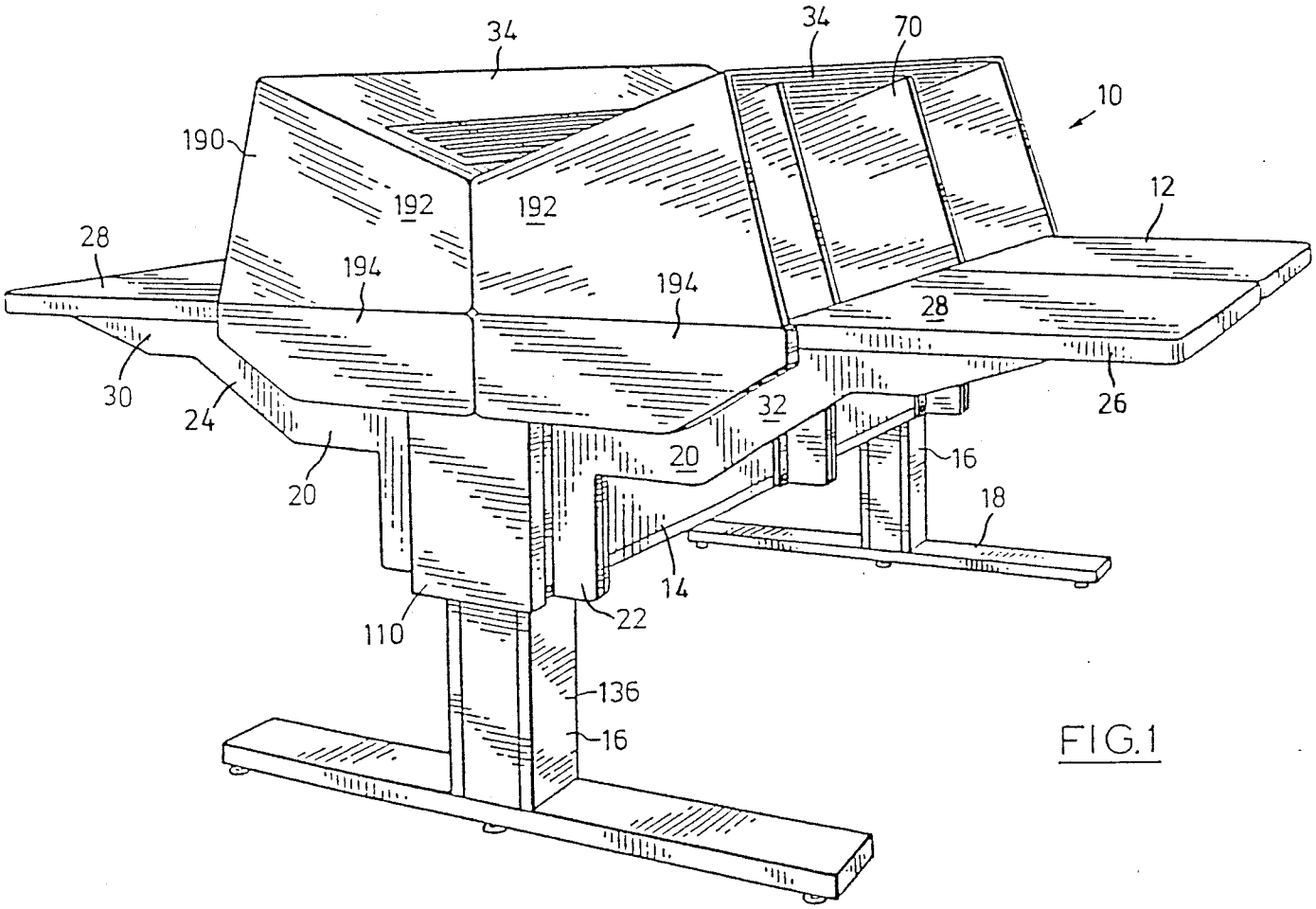
FIG. 1 is a perspective view of a double sided work station constructed in accordance with the invention.

In FIG. 1, there is shown a double sided work station 10 suitable for mounting television or computer montiors, display equipment, and key pad touch equipment and for providing a work surface 12 in front of this equipment. A principal feature of this work station is a straight, elongate hollow support beam 14, the construction of which can be seen more clearly in FIGS. 6*a* and 6*b*. This horizontal beam extends the length of the work station and is suitable as a passageway for electrical and/or communication cables and wiring. As shown, the beam is mounted on two support legs 16 that have feet 18 extending in opposite directions and arranged at a 90 degree angle to the beam. Support brackets 20 are detachably connected to both sides of the beam in the embodiment of FIG. 1 and to only one side of the beam in the single sided version of FIG. 2. Each support bracket includes a vertical leg portion 22 for attaching the bracket to the vertical side of the beam 14 and an outwardly extending arm portion 24. The arm portion 24 not only extends outwardly but also upwardly to work surface means 26. There can be two or more work surface members mounted on each side of the work station to form the work surface means 26. Each work surface member 28 comprises a generally rectangular, rigid plate member with rounded corners and suitable holes in its bottom for the reception of bolts. The work surface members 28 are positioned horizontally away from and above the top of the support beam 14. This arrangement provides the necessary room for mounting the monitors, electrical equipment, and communication equipment on the beam side of the work surface members. It will be noted that the work surface members are mounted on horizontal outer sections 30 of the arm portions 24. Means for mounting the display equipment are detachably mounted on inner sections 32 of these arm portions which can be inclined in part (see FIGS. 1 and 2) or along their entire length (see FIG. 10).

Figure 2:
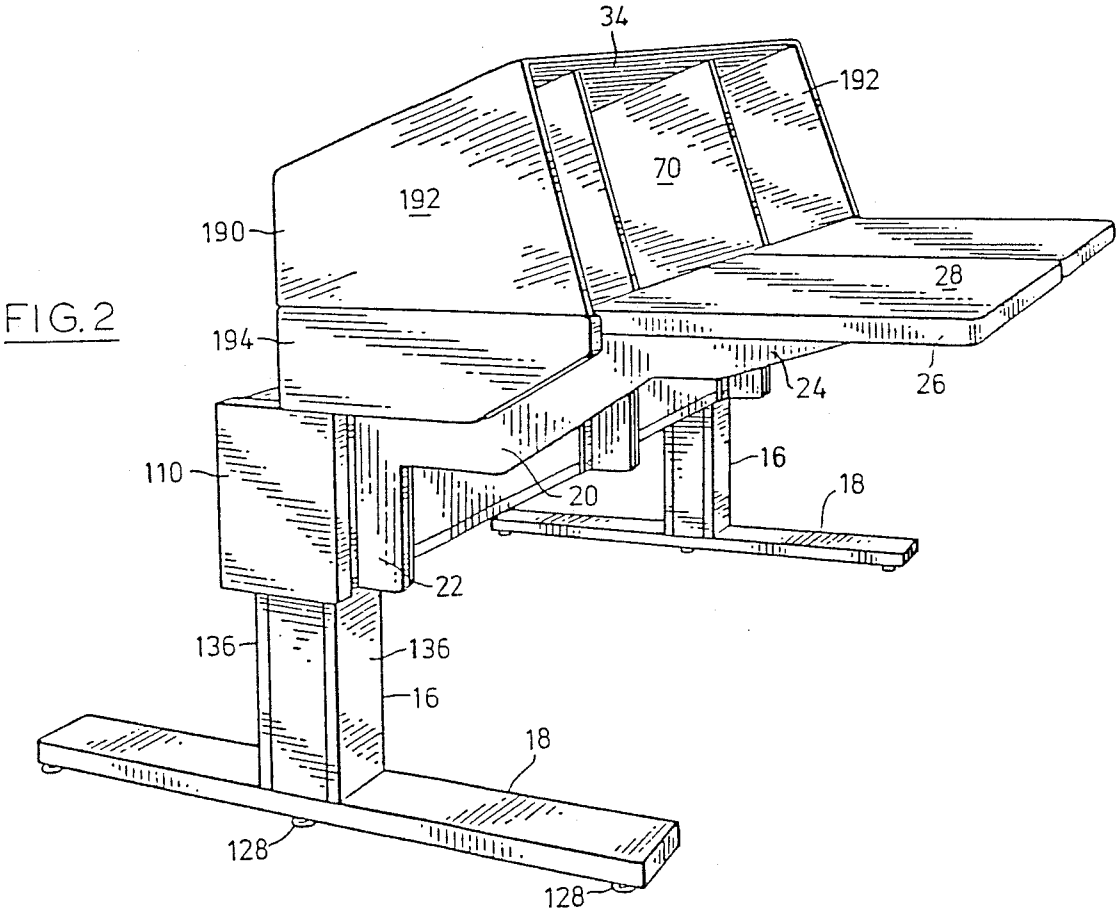
FIG. 2 is a perspective view of a single sided work station that employs components similar to those used in the FIG. 1 embodiment.
Figures 3, 4, 5:
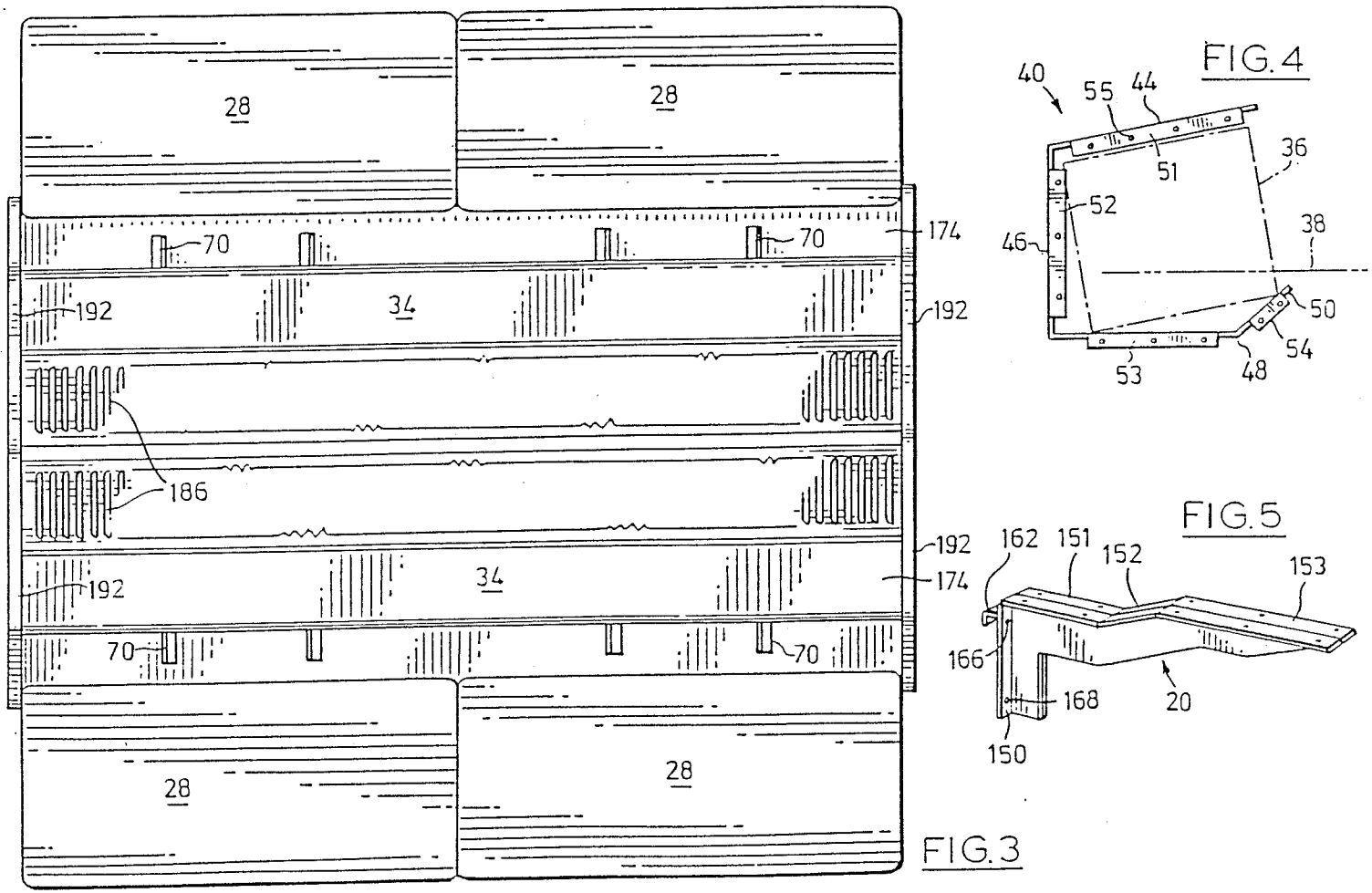
FIG. 3 is a plan view of a work station similar to that shown in FIG. 1.
FIG. 4 is an end view of a housing member used in the work stations of FIGS. 1 and 2.
FIG. 5 is a perspective view of a support bracket used to mount the housing member of FIG. 4 to a beam.

In the embodiments of FIGS. 1 to 3, the mounting means for electrical and communication equipment consists of one or two elongate housings 34. These housings are generally constructed so that a lower portion of the display equipment mounted therein is positioned below a horizontal plane defined by the top of the work surface members 28. This is illustrated in FIG. 4 which shows an end view of a housing member constructed for use in the embodiments of FIGS. 1 and 2. The display equipment is outlined in a broken chain line at 36. The location of a horizontal plane defined by the adjacent work surface is indicated by the dashed line 38 in FIG. 4. The advantages of this arrangement for the equipment will be readily apparent. Firstly, it enables the work station to have a lower profile than would be the case if the equipment were mounted at the same level as the work surface. Secondly, it enables a person sitting at the work surface to look slightly downwardly at the monitor or other equipment, which arrangement can be less tiring for the worker.

Figure 9:
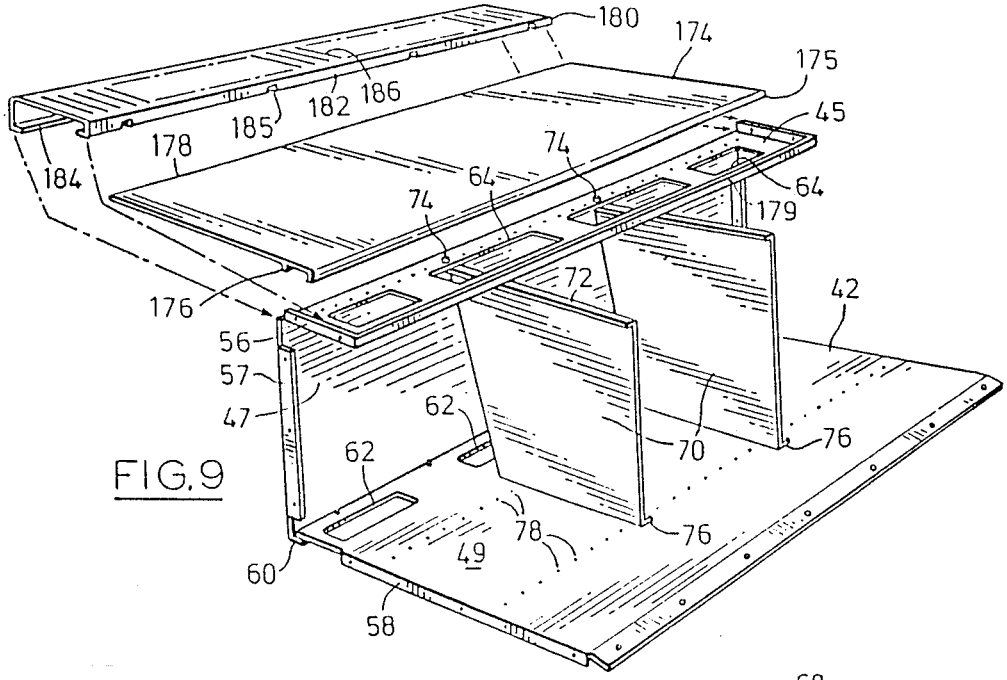
FIG. 9 is a perspective view illustrating an alternative form of housing member for display monitors together with a top cover and a vent plate and indicating how they can be asembled.

The elongate housing 34 can be constructed of one or more housing members such as the housing member 40 shown in FIG. 4 or the alternative version 42 shown in FIG. 9. Both of these versions have at least a top panel 44 or 45, a rear panel 46 or 47, and a bottom panel 48 or 49. In the housing member 40 there is an additional inclined panel 50 extending upwardly and forwardly from the bottom panel 48. The housing member 40 is provided with connecting flanges 51 to 54 at each end which permit the housing member to be attached in a side-by-side fashion to an ajoining housing member 40. The flanges are provided with bolt or screw holes 55 for this purpose. Similarly, the housing member 42 is provided with connecting flanges 56 to 58 at both ends: If desired the holes 55 can be arranged in pairs with one hole of the pair being a tension hole and the other a clearance hole. This permits easy fastening with screws from either direction.

Figure 10:
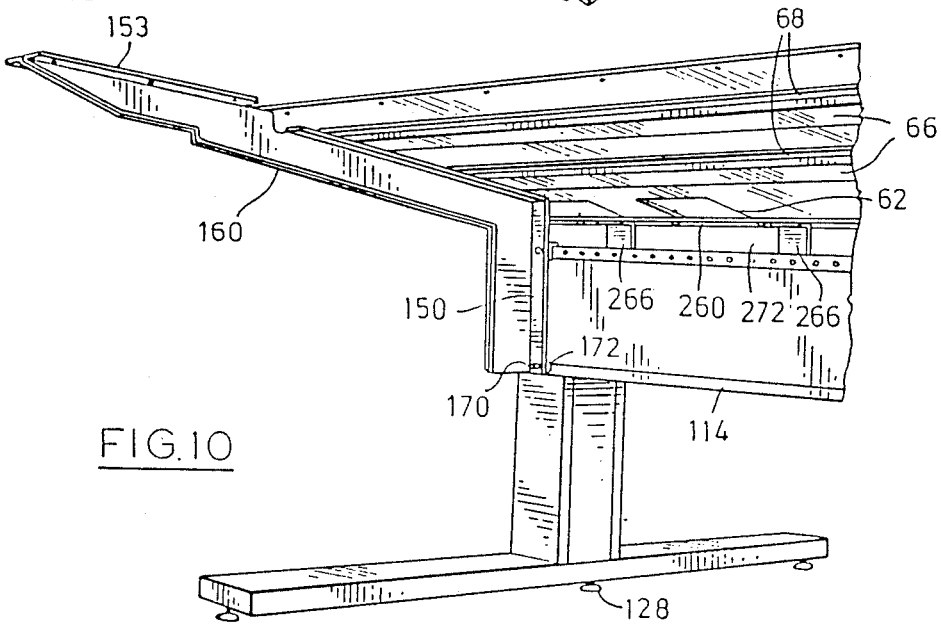
FIG. 10 is a perspective detail view illustrating the bottom of a housing member and the manner in which it is connected to a support bracket positioned directly above a support leg.

Some further details of the housing member 42 are shown in FIGS. 9 and 10. It will be noted that this housing member is made from two separate metal plates attached by bolts along the joint 60 located where the rear panel 47 meets the bottom panel 49. A series of rectangular access openings 62 are formed along the rear of the bottom panel 49 and preferably similar openings (not shown) are provided in the bottom panel 48 of the housing of FIG. 4. Rectangular ventilation openings 64 are provided in the top panel 45 to permit the escape of heated air from the completed housing. The openings 64 can also be used as access routes for cables and wires. Preferably the bottom panel 49 is reinforced by the use of suitable elongate channel members 66. These can be welded by outwardly extending side flanges 68 to the bottom surface of the panel 49. Preferably similar reinforcing members (not shown) are welded to the bottom of the panel 48 in the FIG. 4 version. These members help the housing to support the substantial weight of the electrical equipment. The elongate housing can be divided into suitable sections by metal dividers 70. These are formed with connecting flanges along their top and bottom edges. As shown in FIG. 9, an upper flange 72 can be connected by one or more bolts or screws 74 to the top panel 45. Similarly, a bottom flange 76 is connected by two or more bolts or screws to the bottom panel 49. By providing a series of preformed screw holes 78 in both the top and bottom panels, it becomes possible to move the divders to any desired location in the housing. This renders the housing very flexible as to the type and size of equipment that can be mounted therein. Because the dividers also support the housing top panel 45, a continuous space can be provided which bridges two housing members if desired.

The construction of the support beam will now be described with particular reference to FIG. *6b* which shows a preferred form of this beam as well as a removable metal panel 80. The illustrated beam is of generally rectangular cross-section with its long sides 82 extending vertically. These long sides are constructed from two elongate and identical plate members. Each of these plate members is bent twice at the top to form a L-shaped connecting flange 84. The upright leg of this flange has a series of bolt holes 86 formed therein, which holes can be used for the attachment of the aforementioned support brackets 20. If desired, these holes 86 can be reinforced by the provision of metal strips 88 located on the inside of the L-shaped flanges and through which the holes 86 also extend. The long sides of the beam are connected at the top by a flat metal plate 90 that has a series of large rectangular access openings 92 formed therein. The top plate 90 can be joined to the larger side plates by welding. The edges of the top plate are connected to the L-shaped flanges and together they form a tray section 94 on the top of the beam for carrying wiring and/or cables, particularly communication cables. This wiring can be brought into or out of the tray section through the aforementioned openings 92.

Formed in both sides of the beam are further rectangular access openings 96 with the ones at the end of the beam being smaller in width than the other openings 96. In the space between these openings are spacing and connecting plates 98. Each of these plates has a relatively large central section 100 that is welded to the outside of the beam and L-shaped end flanges 102. On the outer surface of these flanges is provided adhesive or possibly magnetic tape 104 for the attachment of a cover panel 80. Only one of these panels 80 is shown in FIG. *6b* for the sake of illustration but, it will be appreciated that two or more of these panels can be provided along each side of the beam where required. A space is preferably provided between each bracket 20 or 160 and the adjacent beam to permit these panels to be moved or shifted sideways without removing an overlying bracket. Thus panels can easily be moved or removed at any time to gain entry to the interior of the beam either for the installation of new wiring or cables or for repair purposes. At each end of the beam, connecting flanges 106 are formed. These flanges contain bolt holes 108 that permit each end to be connected by bolts to the end of another beam. Alternatively, a cover plate 110 can be connected by bolts to the end of the beam. Such a cover plate has a pleasing appearance and conceals the end of the beam and the wiring contained therein.

The bottom of the beam 14 is shown in FIG. 6*a*. It is made from a single elongate metal plate having a series of rectangular openings 112 for insertion of top end portions of the legs into the beam for the support thereof. The bottom plate 114 has up turned side flanges 116 that are visible when the beam is installed. The outer edge portions of the bottom plate are welded to outwardly extending flanges 118 formed on the bottom of the side plates. A series of bolt holes 120 are optionally formed on both sides of the beam along the entire length thereof as shown in FIG. 6*a*. These holes extend through both the edges of the bottom plate 114 and the flanges 118. Finally, it should be noted that the openings 122 at each end of the beam are open ended. This permits the attachment of a leg at the end of a beam that is connected to the end of another beam. Such a leg can be placed so that it bridges the joint between the beams.

The construction of the support legs will now be described with reference to FIGS. 1 and 7. As indicated, the leg 16 shown in FIG. 1 has two feet 18 extending in opposite directions. The leg 125 shown in FIG. 7 is essentially similar in its construction except that it has a single foot 127 extending from the bottom of the upright portion 128. It will be appreciated that the leg 125 could be substituted for the leg 16 shown in FIG. 2 since this would not result in an unbalanced work station. The leg 125 has the advantage of requiring less room when used with a single sided work station. Preferably both types of legs are provided with adjustable levelers 128. These are of well known construction and are commonly used on furniture of various types.

The upright portion 128 of each leg preferably has a rectangular horizontal cross-section and its horizontal dimensions correspond closely to the dimensions of the openings 112 in the bottom of the beam. Preferably, both the top and bottom ends of the portion 128 are open to permit cables and wires to be run up through this portion of the leg and into either the aforementioned tray section at the top of the beam or, in the case of electrical wiring, into the beam itself. In the illustrated leg of FIG. 7, the upright portion has rectangular access openings 130 and 132 on all four sides thereof with the openings 132 being wider than the openings 130. These openings permit wires and cables to be run in and out of the leg from the side rather than the top. In addition, a large rectangular opening 134 can be provided in the lower half of the upright portion of the leg, both on the side facing the foot 127 and on the opposite side. The openings 134 allow the service man greater ease in routing an additional cable. In order to close these openings 134, cover plates 136 can be provided on each side of the upright portion as shown in FIGs. 1 and 2. These cover plates can be attached by any suitable means such as adhesive or magnetic tape or Velcro* strips. Finally, the upright portion of the leg is provided with a number of bolt holes 138 to enable attachment of the top end portion to the beam. In the illustrated embodiment of FIG. 7, there are six holes 138 surrounding each of the openings 132. These bolt holes 138 are aligned with corresponding bolt holes 140 formed in the two vertical sides of the beam 14. Four bolts 141 and nuts 142 are shown in FIG. 8 and these are used to detachably connect a top end portion of the leg to the end of the beam 14. If desired, bolts that span the width of the beam can be used instead of short bolts. It should be particularly noted that the upper end of the leg does not pass beyond the top plate 90 of the beam. Thus, the tray section formed at the top of the beam is left clear for the free horizontal passage of wires and cables therealong.

* trade mark

The construction and use of the support brackets will now be described with particular reference to FIGS. 5, 8 and 10. Each support bracket 20 can be formed from two metal plates welded together in side-by-side fashion. Each of these plates is formed with flanges extending perpendicularly to a vertical plane extending down the centre of the bracket. In the bracket of FIG. 5, the connecting flanges include a vertical flange 150, a horizontal flange 151, an upwardly and forwardly extending flange 152 and a horizontal outer flange 153. All of these flanges are formed with suitable bolt or screw holes for attachment purposes to be described. In the embodiment of FIG. 10, the bracket 160 also has the aforementioned vertical flange 150 on each side thereof and the outer horizontal flange 153 to which is connected the work surface member. Between these two flanges extends a straight, sloping flange 156 to which is connected the aforementioned housing member 42 in FIG. 9.

To the rear of each of the brackets 20 and 160 is attached a L-shaped connector 162. A downwardly extending portion of the connector 162 is formed with two threaded holes to accommodate and hold connecting bolts 164. These bolts extend through two of the holes 86 provided along the top edges of the beam. In order to connect one of the brackets 20 or 160 to the beam, the L-shaped connector 162 is placed over the upstanding connecting flange 84 and the bracket is lowered so that it rests on the top of and against the side of the beam. Two bolts are then placed through the holes 166 at the top end of the vertical flanges and through the holes 86 and finally secured in the threaded holes in the connector 162. This mechanism allows for a secure connection between the bracket and the beam 14 while maintaining flexibility in terms of location along the beam. Where high voltage electrical equipment is concerned, such a connection can be required.

At the bottom of each bracket, an adjustment mechanism is provided to enable the work surface member connected to the bracket to be levelled. Thus the position of each support bracket relative to the support beam is adjustable in order to maintain the top of the work surface level. A threaded hole shown at 168 in FIG. 5 is provided in each of the vertical flanges 150. A threaded rod 170, (see FIG. 10) extends through each hole 168 and at one end of this rod there is a round knob or foot 172 which rests against the side of the beam and, in particular, the upturned edge of the bottom plate 114. By simply turning the foot 172 and the threaded rod attached thereto, the position of the bracket 20 or 160 and the work surface connected to the bracket levelled can be adjusted relative to its support beam.

The housing member 42 is provided with a detachable top 174. The top is provided with a rounded front edge 175 and a short downwardly extending flange 176 that extends the length of the top a short distance from the edge. The rear edge 178 rests against an upwardly turned flange 179 extending along the front edge of the top panel 45. Preferably the top 174 has a slight slope downwards towards the rear of the housing member in order that it can serve as a paper tray. The rear edge of this paper tray is formed by a vent cover 180 which has a L-shaped flange 182 formed along its front edge. The flange 182 sits on the top 174 just in front of the flange 179. Extending along the rear of the vent cover 180 is a larger L-shaped flange 184. The vertical portion of this flange is in vertical alignment with the rear panel 47. The horizontal portion of this flange rests on the rear section of the top panel 45. A number of ventilation slots 186 are formed in the vent cover 180 and these permit hot air to escape from the housing via the aforementioned openings 64. Also cable openings 185 are provided to allow cable access routes to the housing top for any equipment located there.

Figure 11:
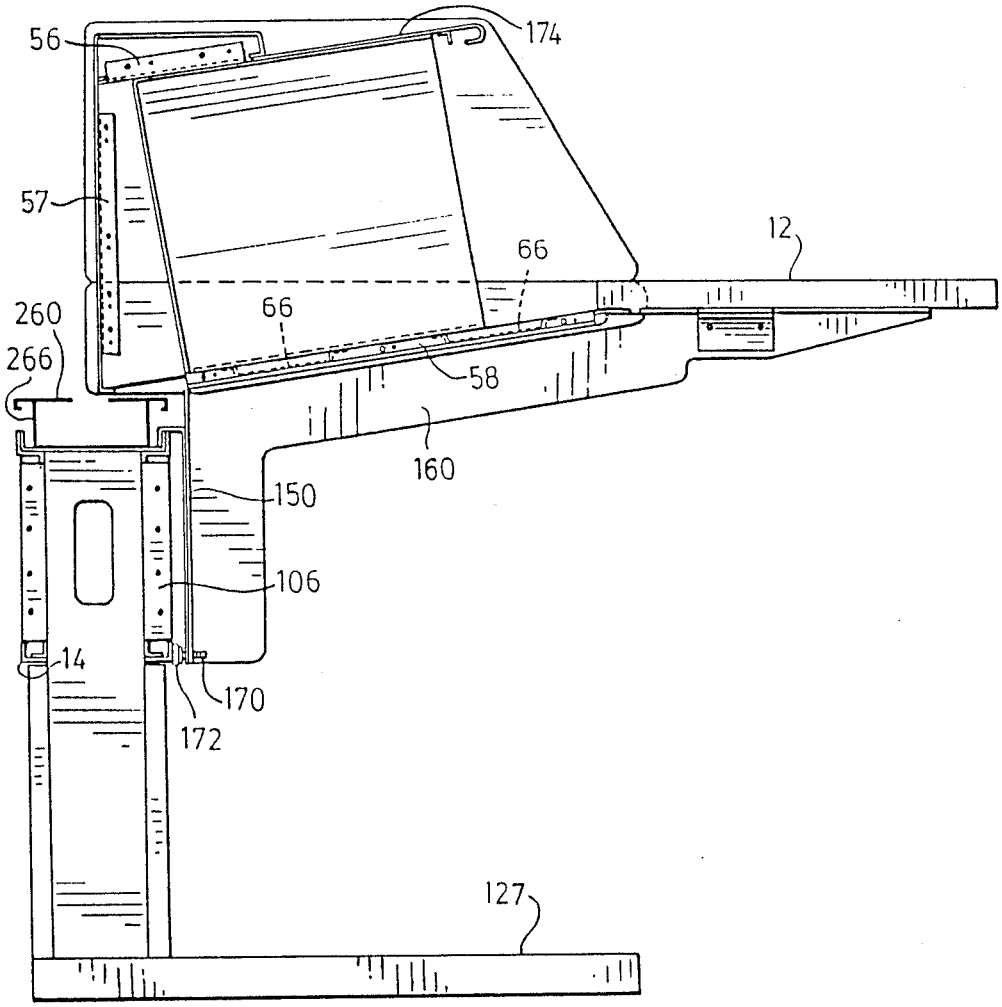
FIG. 11 is a sectional view of a work station employing the housing member of FIG. 9 and the bracket of FIG. 10.
Figure 12:
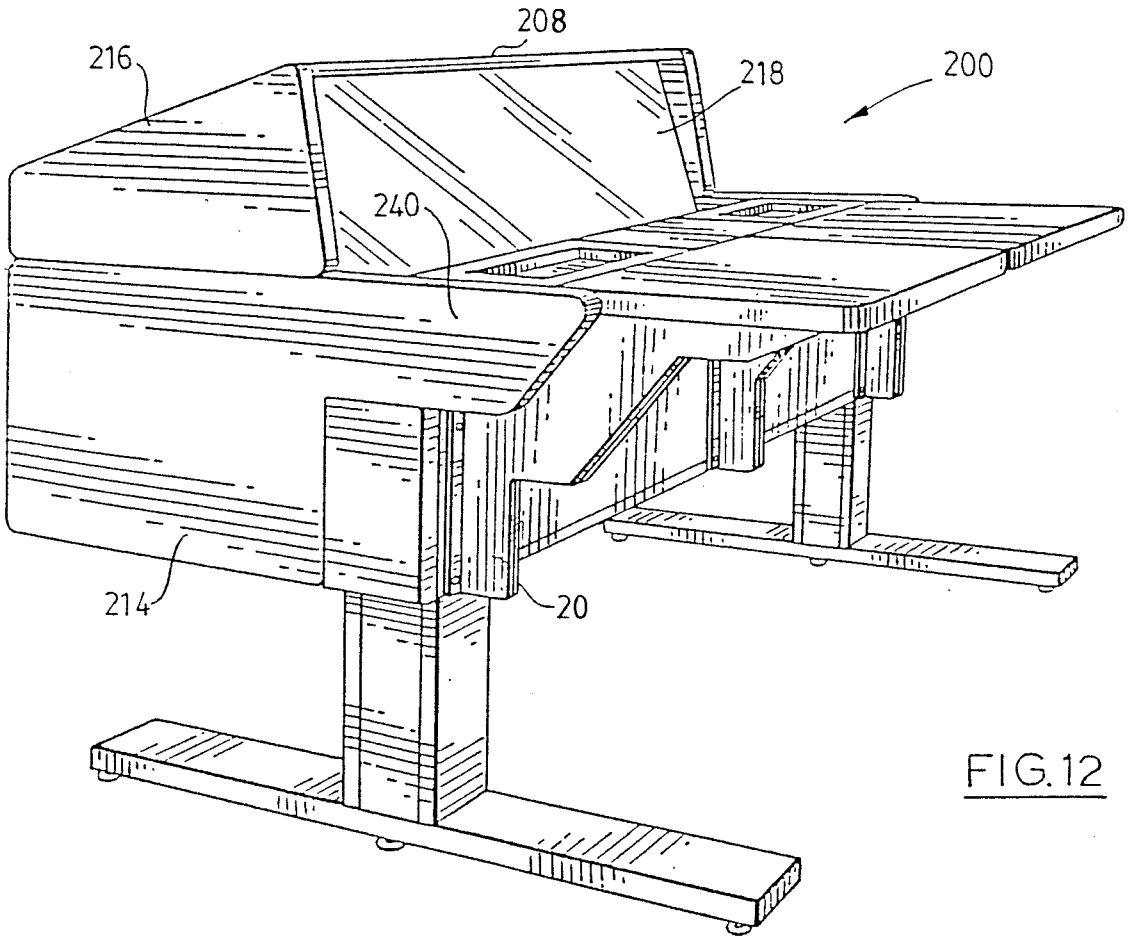
FIG. 12 is a perspective view of another embodiment of a work station, which view is taken from the left and front sides.
Figure 13:
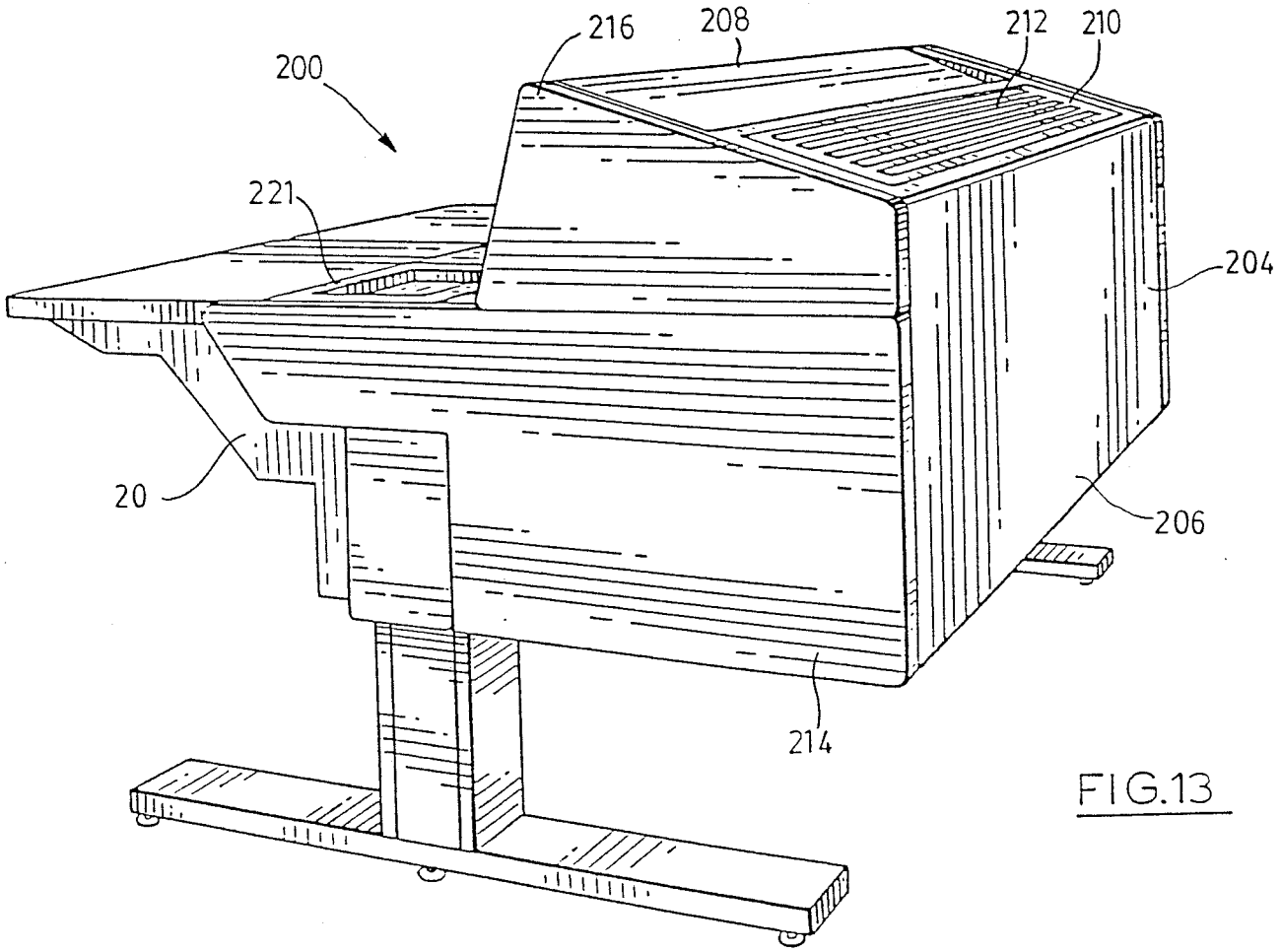
FIG. 13 is another perspective view of the embodiment of FIG. 12, which view is taken from the right and rear sides.
Figure 14:
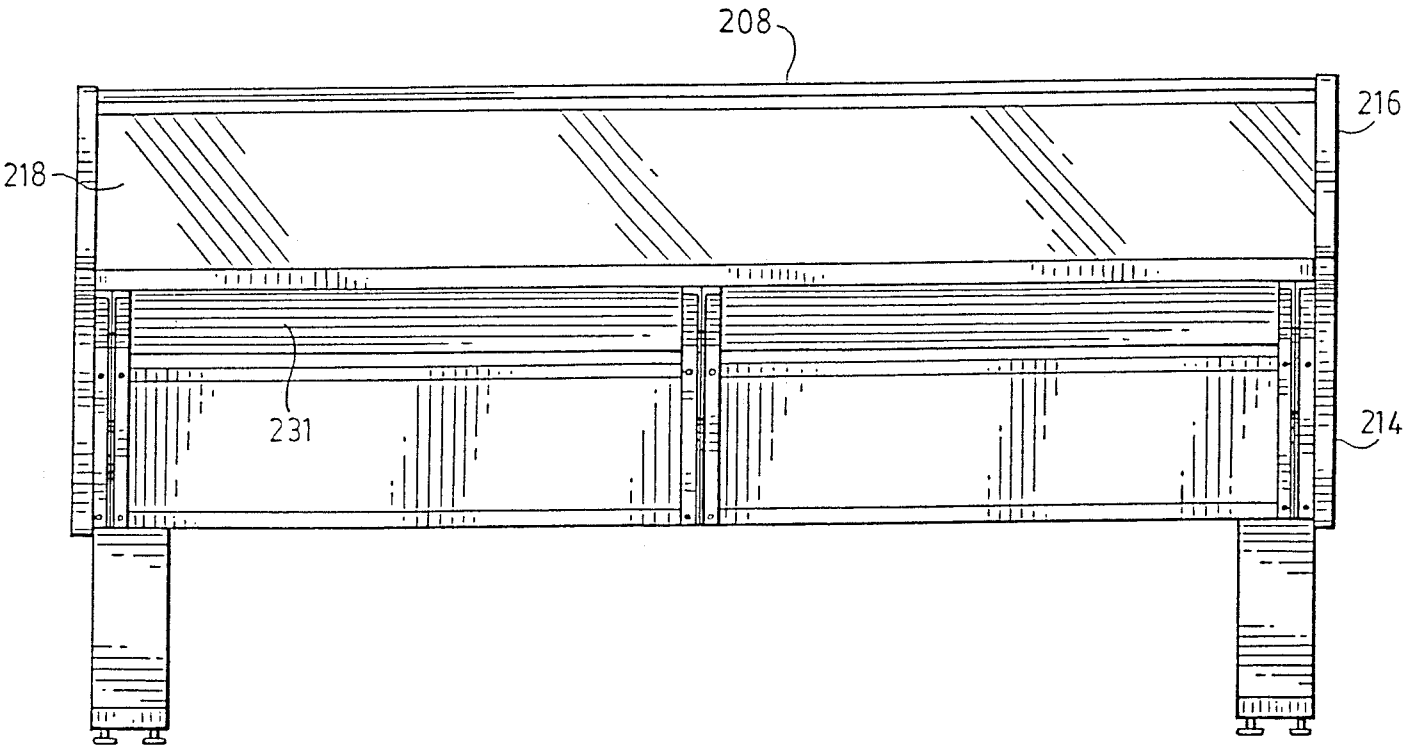
FIG. 14 is a front elevation of the work station of FIG. 12.
Figure 15:
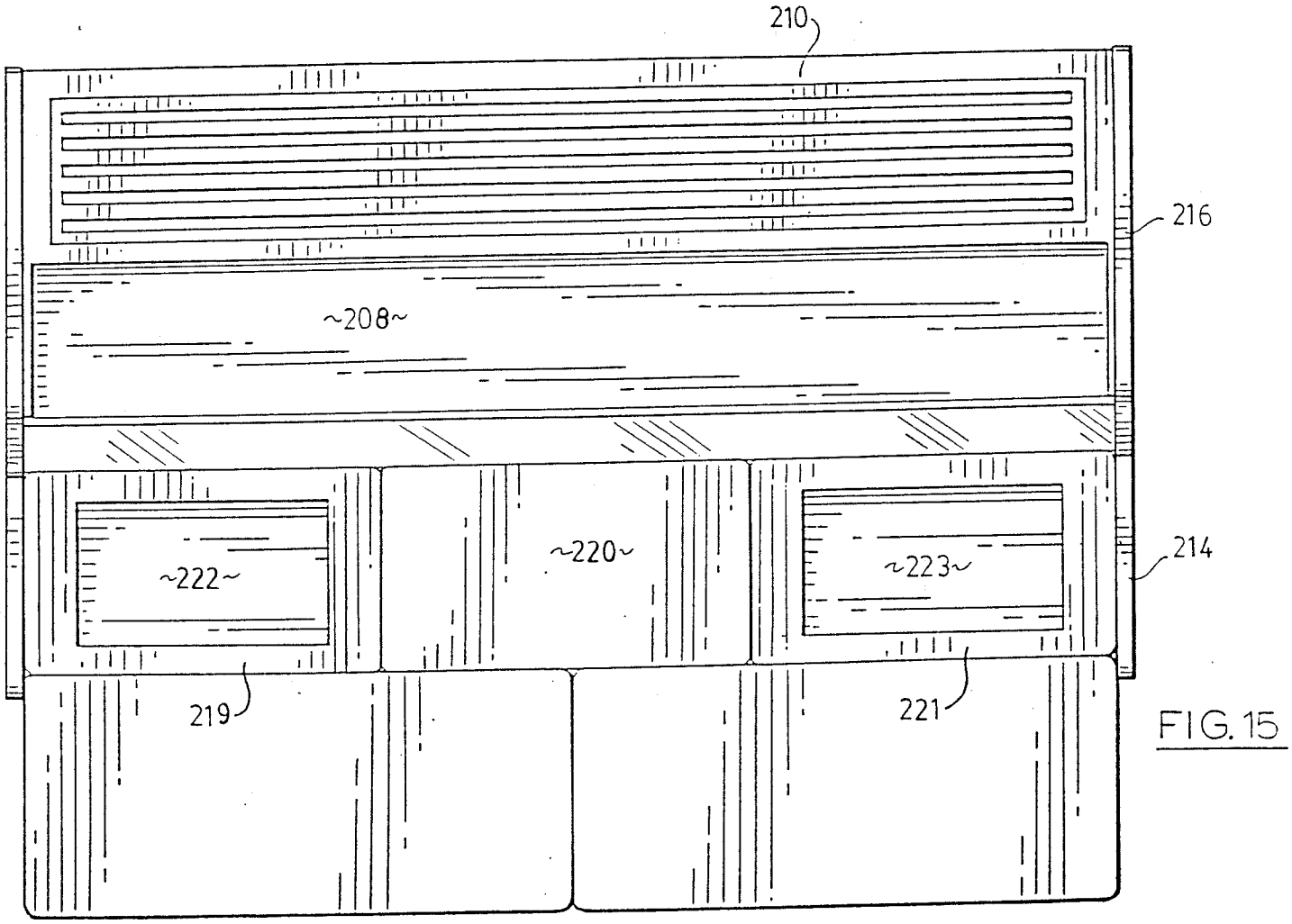
FIG. 15 is a plan view of the work station of FIGS. 12 and 13.
Figure 16:
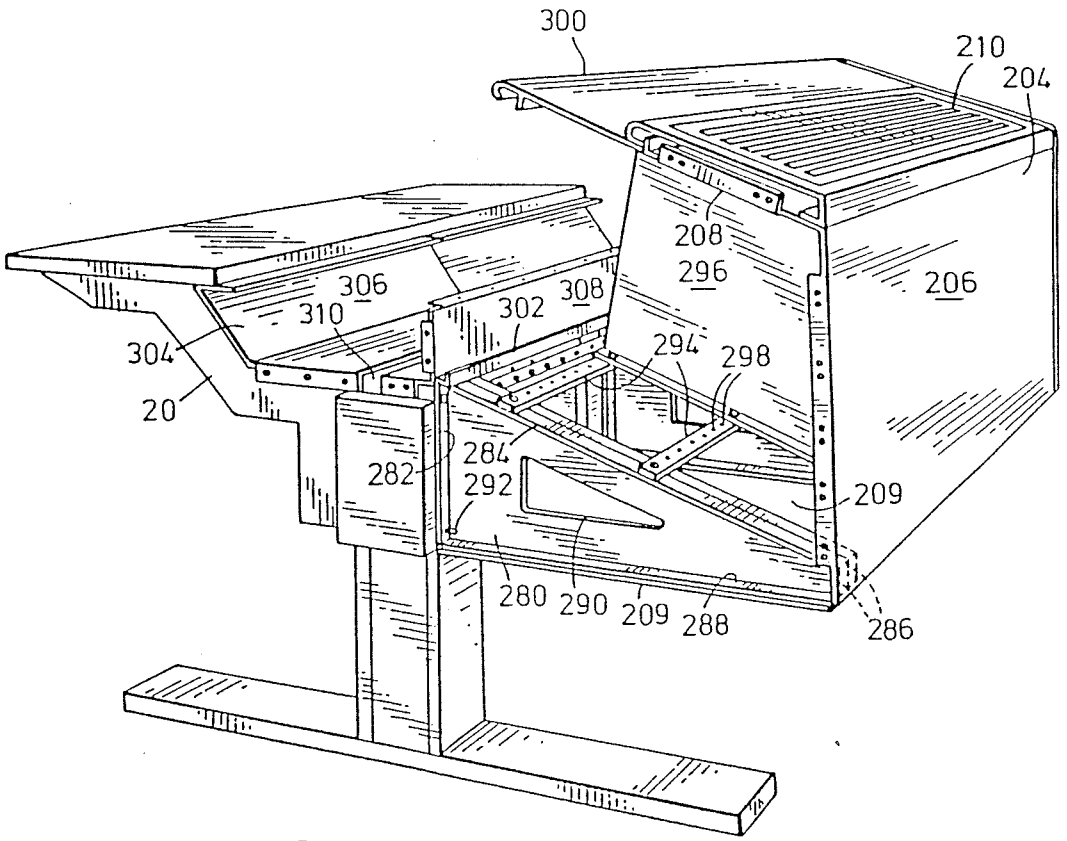
FIG. 16 is a perspective view similar to FIG. 13 but with two end panels removed in order to show the interior of the housings.

The ends of the elongate housing are covered by detachable end walls 190. These end walls can be attached by bolts (not shown) that extend through the connecting flanges 51 to 54 shown in FIG. 4 and 56 to 58 shown in FIG. 9. In the embodiment of FIG. 2, each end wall 190 comprises an upper plate 192 and a small lower plate 194. In the double sided work station of FIG. 1, there are two plates 192 and two plates 194 at each end. As shown in FIG. 3, these cover plates are located slightly outwardly from the ends of the work surface members 28. The work station 200 shown in FIGS. 12 and 16 is similar in its design to the work station of FIG. 2 except that the housing for the computer monitors or other display equipment is much larger and is positioned on the side of the beam opposite the work surface 202. Only those features which differ in their construction or that are not found in the embodiments of FIGS. 1 and 2 will be described herein. The housing means 204 can be constructed of two or more housing members in the same manner as described above. However, in this version, the housing has a large extended rear panel 206, a top panel 208 (see FIG. 16) that is connected at the back to the rear panel, a separate bottom panel 209 (optional), and a vent cover 210. Slots 212 in the vent cover extend lengthwise of the work station from one end to the other. Affixed to each end of the housing are a large end panel 214 and a smaller, upper end panel 216. Both of these end panels can easily be removed for maintenance purposes or the installation of new equipment or additional wiring. In the illustrated embodiment, the front of the housing is covered by an anti-glare glass or screen 218 which is recessed from the front edges of housing as shown in FIG. 11. It will be understood that such screens have been omitted from the previously described embodiments for purposes of illustration but all of these work stations can be equipped with such screens where required.

Figure 21:
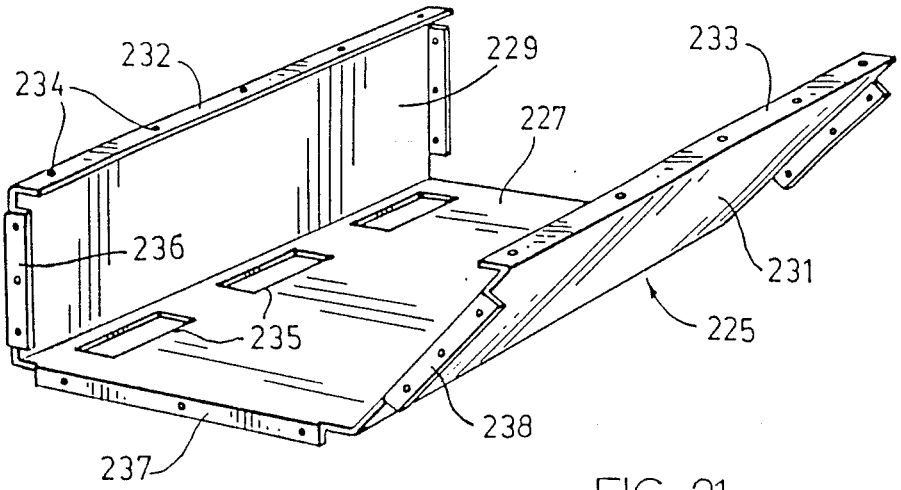
FIG. 21 is a perspective view showing an open topped enclosure suitable for use with the embodiments of FIGS. 17 to 20.
Figure 22:
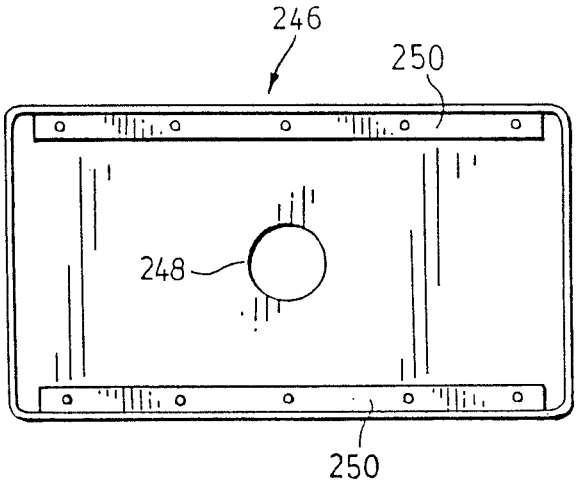
FIG. 22 is a bottom view of a cover plate used with the enclosure of FIG. 21.

Mounted in front of the housing and on top of the beam are horizontal panels 219 to 221 which are of the same horizontal dimensions. The outer panels 219 and 221 have large rectangular openings 222 and 223 in which can be mounted electrical or electronic equipment such as calculators, computer keyboards, or communication equipment such as business telephones. The position of this equipment can be easily adjusted by moving or interchanging the panels 219 to 221. These panels are mounted on a housing member or open top enclosure 225 which is shown in FIG. 21. It will be understood that the enclosure 225 is bolted to the support brackets 20 in the same manner as the housing member 40. The enclosure 225 has a bottom 227, a rear panel 229 and a front sloping panel 231. The top edges of panels 229 and 231 are formed with connecting flanges 232 and 233 having holes for bolts or screws at 234. The panels 219 to 221 normally simply rest on these flanges and are not attached thereto. Only special panels such as those with dangerous high voltage switches, etc., are secured by screws into the holes 234. The panels 219 to 221 have underlying flanges which permit them to rest on the flanges 232 and 233. In the same manner as the housings already described, the housing or enclosure 225 is provided with access openings 235 along the rear and connecting flanges 236 to 238 at each end. Thus, the enclosures 225 can be connected to similar enclosures in end-to-end fashion to construct elongate housings of various lengths. The forward sections 240 of the large end panels 214 are connected to the flanges 237 of the adjacent enclosures.

FIG. 16 shows part of the interior of the large housing means 204 and the support therefor. The housing is supported from below by substantially trangular support brackets 280. Each bracket 280 can be constructed from two metal sheets welded back-to-back in the same manner as the aforementioned brackets 20. Around the perimeter of each bracket 280 are outwardly extending flanges including a vertical flange 282 that is connected to the beam, a long sloping flange 284, a short vertical flange at the outer end of the bracket indicated in dashed lines at 286, and a horizontal bottom flange 288. The bottom plate 209 which covers the bottom of the housing means and which is connected to the bottom flanges 288 is optional. The central web of each bracket 288 preferably has an opening 290 to permit the passage of cables and wires through the bracket. It will be understood that the bracket 280 hangs from the support beam 14 in substantially the same manner as the brackets 20 and the level of each bracket 280 can be adjusted in the same manner by a threaded adjustment mechanism at 292.

Preferably there are mounted on the brackets 280 longitudinally extending rails 294 to which the large dividers 296 are attached. In order to attach the bottom of the dividers with screws or bolts, the rails 294 are provided with a series of holes 298. In the same manner as the housing of FIG. 9, the top edges of the dividers 296 are attached by bolts or screws to the top panel 208. Resting on the dividers 296 and supported thereby is a separate removable top 300. As shown in FIG. 16, a front portion of the vent cover 210 rests on top of the rear edge of the top 300 and helps to hold the top in place. Extending along the front of the brackets 280 and at the top corners thereof is an elongate angle member 302. This member can be used to support the bottom edge of an anti-glare screen.

Overlying the beam in FIG. 16 and supported in part by the brackets 20 is a split enclosure means 304. This enclosure is similar to that shown in FIG. 21 except that it is split completely into a forward section 306 and a rear section 308. Between these two sections is an elongate slot 310 for the passage of cables and wires into the enclosure means 304. The forward section 306 is connected by suitable screws to flanges of the brackets 20.

The rear section 308 can be attached to the top of the beam 14 in any suitable manner, including the attachment of the section by bolts or screws to the brackets 266 shown in FIG. 23.

Figure 17:
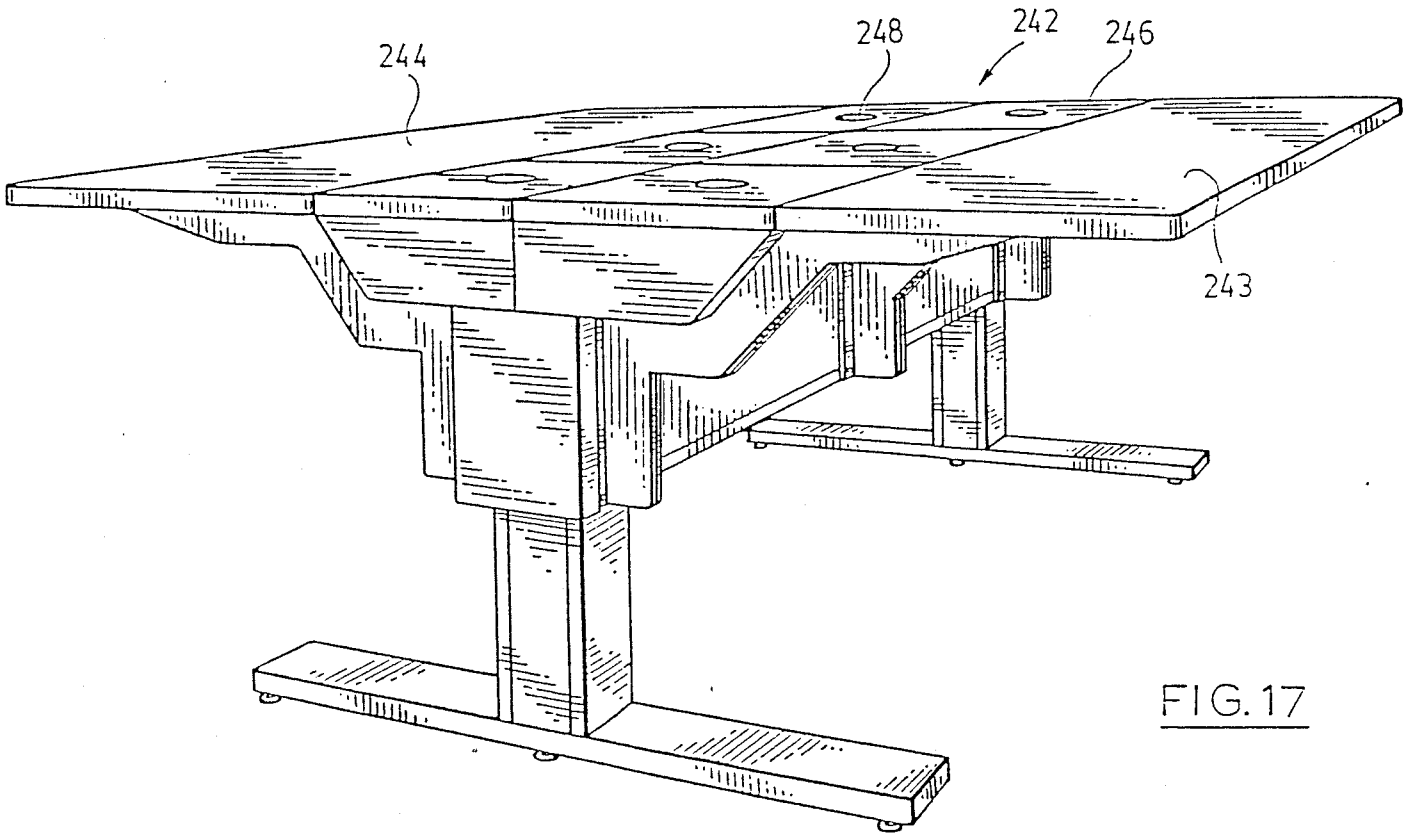
FIG. 17 is a perspective view of a double-sided work station having a flat top.
Figure 18:
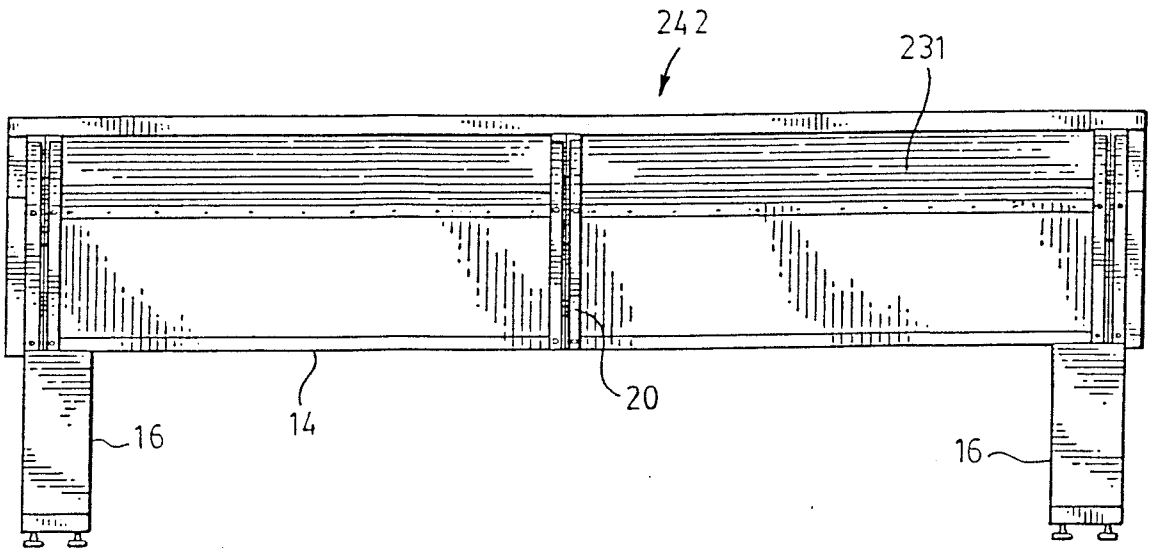
FIG. 18 is a side elevation of the work station of FIG. 17.
Figure 20:
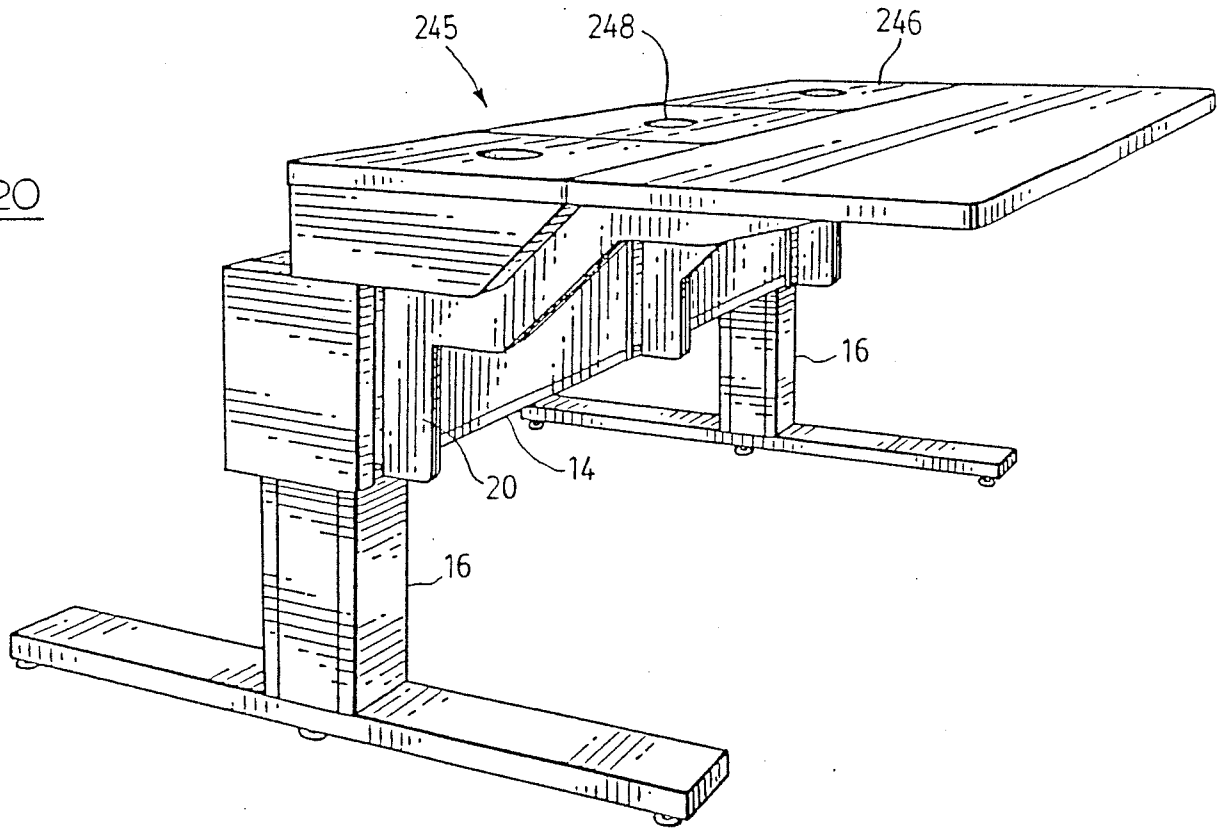
FIG. 20 is a perspective view of the aforementioned single sided work station having a flat top.

FIG. 17 illustrates a two-sided work station 242 which has a substantially flat top extending from the work surface 243 on one side to the work surface 244 on the opposite side. FIG. 20 illustrates a work station 245 of similar construction but it is one sided. Again, it will be appreciated that the legs 16 shown in FIG. 20 could be replaced by legs like the leg 125 shown in FIG. 7. Between the work surfaces 243 and 244 are rectangular, removable panels 246. In the FIG. 17 embodiment there are six of these panels arranged in two rows while in the FIG. 20 version there are three of these panels. Each panel has an access hole 248 in the centre thereof for the passage of wiring or cables. It will be appreciated of course that each of the panels could be provided with further access openings or could be replaced by a similar panel with no opening at all. Connecting flanges 250 can be provided on opposite sides of each panel to provide a means for connecting it to an enclosure or housing 225. The panels can be connected by bolts or screws (not shown) or can simply rest on the flanges 232 and 233 (held by gravity only).

Figure 19:
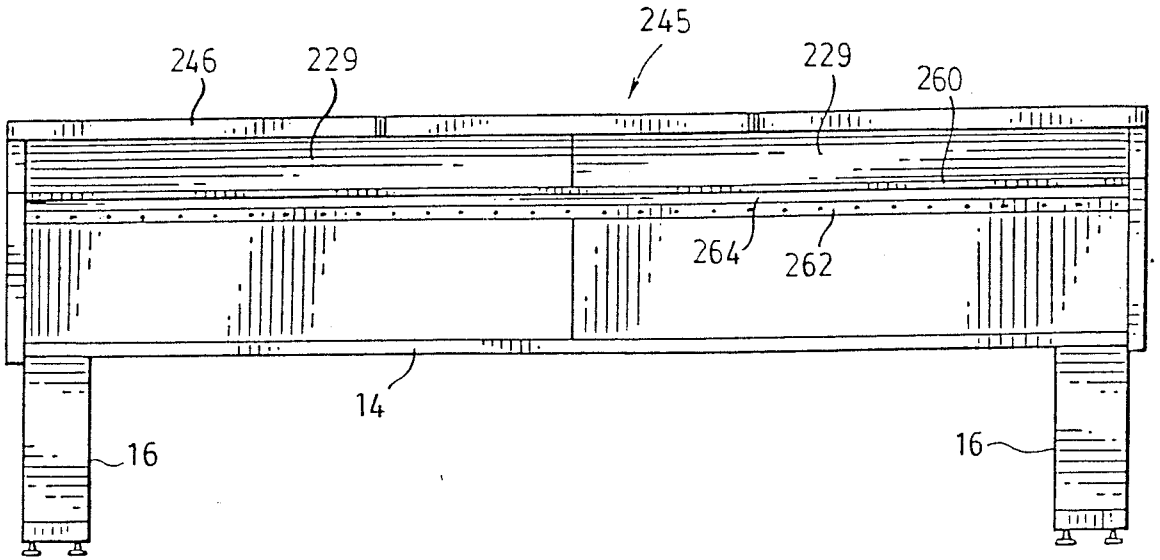
FIG. 19 is a rear elevation of a single sided work station having a flat top.

The rear of the work station 245 is shown in FIG. 19. Below the panels 246 can be seen the rear wall 229 of each enclosure 225. Extending rearwardly from the rear panel 229 is a narrow cover plate 260. One end of a cover plate 260 can be seen clearly in FIG. 23. This cover plate can extend the entire length of the beam 14 if desired. Located between the edge of the cover plate 260 and top edge of the beam located at 262 is an elongate slot 264 through which wiring and cables can be fed. The use of the slot 264 is particularly useful where the beam juntions with another beam at 90° angle as the slot allows cables to cross over and access the cable tray in the adjacent beam. Cables can be distributed from the tray at the top of the beam to work stations straight up or to either side.

Turning now to FIG. 23 which shows brackets 266 that can be used to mount the aforementioned cover plate 260, these brackets are spaced along the length of the beam and are mounted on the top plate 90 when required. There are two brackets 266 at each location and these are formed by a single bent plate having a connecting portion 268. At the top of each bracket is an outwardly extending flange 270 having bolt or screw holes formed therein. The brackets 266 have at least two possible functions, one of these being the support of the plate 260. It will be appreciated that the plate 260 is particularly useful in the case of a one sided work station since it can be used to cover approximately one-half of the top of the beam. Another use of the brackets 266 is the provision of a beam mounted support that can be connected to the rear end of the housing members. This use of the brackets is illustrated in FIG. 10. Gaps 272 are formed between the brackets 266 and these can be used to feed cables and wiring from the tray section of the beam and into the housing member through the access openings 62.

It will be appreciated by those skilled in this art that various modifications and changes can be made to these work stations without departing from the spirit and scope of this invention. For example, although the preferred height for the beam 14 for most applications would be a maximum of about two feet, the height of the beam can readily be varied to suit the particular application for the work station. It is simply a matter of making the legs 16 longer or shorter to provide the required beam height. Although an open space is shown below the beam in the illustrated embodiments, it will be appreciated that the space below the beam could readily be covered by the insertion of a partition or by extending the cover plates on the sides of the beam.

Furthermore, it will be appreciated by those skilled in the art that the work stations of the present invention are readily adaptable to providing a wide variety of work station configurations in an office. For example, three of the beams could be connected at a single point so as to extend radially from this point. It would simply be necessary to provide a suitable triangular connector where the beam ends meet. This connector can be hollow to permit the passage of wiring and/or cables therethrough. Similarly, it would be possible to connect two beams at a 45 degree angle to one another by the use of a suitable triangular connector. A 90 degree junction bracket which allows the end of one beam to be supported from the upright flange 84 of another beam and at a point anywhere along this beam is shown in FIG. 24.

The 90 degree junction bracket 312 is generally rectangular and has a rectangular opening 314 to permit the passage of wires and cables from the beam 14 to an adjoining beam. At the top of the bracket is a L-shaped flange 316 that is similar in its construction and use to the flange 162 of each support bracket 20. The downwardly extending leg 318 of the flange has at least two threaded holes 320 that can be used to secure the bracket to the adjoining beam. Just below the top of the bracket is a small rectangular opening 322 for the passage of communication cables from the tray section at the top of the beam 14 into the tray section of the adjoining beam. Bolt holes 324 are provided along each side of the bracket and enable it to be connected to the connecting flanges 106 at the end of the beam 14. The bracket is connected in such a manner that the beam 14 will be at the same height as the beam to which it is connected.

In addition to the types of equipment already mentioned, the present work stations can also be used to mount and house microphone and speaker equipment.

In some cases, it may be desirable to avoid the use of magnetic tape in order to attach cover panels, etc.. Particularly where computers are being used the tape may effect such equipment. The magnetic tape can be replaced by other suitable known connectors, including pressure sensitive adhesive tape.

It should also be appreciated that the housings used in the present work stations can be equipped with adjustable height platforms if desired to mount monitors and other equipment therein. This permits the equipment to be arranged at any desired height. In the embodiment of FIG. 16 these platforms are mounted on the rails 294.

The beam used in the present invention enables the electrical wiring to be segregated from the communication cables which can be run along the top of the beam in the tray section. This is considered important in the industry because it prevents distortion of the transmissions in the cables by the electrical wiring.

What I claim as my invention is:

1. A work station suitable for mounting electrical and/or communication equipment comprising a straight, elongate hollow support beam adapted to extend horizontally in use and suitable as a passageway for wiring; support legs for mounting said beam in a horizontal position above a floor; support brackets each detachably connected to a side of said beam and solely supported thereby, said brackets including arm portions with inner sections that extend outwardly and upwardly and outer sections that extend horizontally and outwardly from top ends of said inner sections; work surface means mounted on said outer sections of said arm portions, said work surface means being positioned horizontally away from and above the top of said support beam; and enclosure means for mounting said equipment on said inner sections of said arm portions so that a lower portion of the said equipment is positioned below a horizontal plane defined by the top of said work surface means, said enclosure means being located on said inner sections.

2. A work station according to claim 1 wherein said support beam is generally rectangular in transverse cross-section with its long sides, as the beam is viewed in transverse cross-section, extending vertically and the top of said support beam mounted on said support legs is no more than two feet above said floor.

3. A work station suitable for mounting electrical and/or communication equipment comprising a straight, elongate hollow support beam suitable as a passageway for wiring, said beam being generally rectangular in transverse cross-section with its long sides, as the beam is viewed in said cross-section, extending vertically, the bottom of said support beam having a number of evenly spaced openings along its length; support legs for mounting said beam horizontally above a floor so that the top of said beam is no more than two feet above said floor, top end portions of said support legs being inserted into selected ones of said openings in order to mount said beam on said suppport legs; means for securing said top end portions of said legs in said support beam; support brackets each detachably connected to a side of said beam, said brackets including arm portions with inner sections that extend outwardly and upwardly and outer sections that extend from top ends of said inner sections; work surface means mounted on said outer sections and positioned horizontally away from and above said support beam; and enclosure means for mounting said equipment on said inner sections of said arm portions so that at least a lower portion of said equipment is positioned below a horizontal plane defined by the top of said work surface means, said enclosure means being located on said inner sections.

4. A work station according to claim 3 wherein said mounting means for said equipment comprises an elongate housing having at least a top panel, a rear panel, a bottom panel and two end walls, said bottom panel being detachably mounted on said support brackets and said rear panel being positioned above said beam.

5. A work station according to claim 3 wherein each inner section that extends outwardly and upwardly from said support beam is inclined, and wherein said mounting means for said equipment comprises an elongate housing having a bottom panel that is detachably mounted on the inclined inner sections of said arm portions.

6. A work station according to claim 1, wherein the position of said support brackets relative to said support beam is adjustable in order to maintain the top of said work surface means level.

7. A work station according to claim 1 wherein said support brackets are detachably connected to both sides of said beam and solely supported thereby, said work surface means are mounted on said outer sections of said brackets on both sides, and said enclosure mounting means for said equipment include two elongate housings arranged back-to-back and mounted directly on said inner sections of said arm portions between the work surfaces.

8. A work station according claim 7 wherein said inner sections are inclined and each housing includes a bottom panel that is detachably mounted on said inclined inner sections of said arm portions.

9. A work station suitable for mounting electrical and/or communication equipment comprising a relatively large, straight, hollow support beam of sufficient strength to support work surfaces on either or both sides thereof in cantilever fashion, support legs for mounting said beam in a horizontal position above a floor; support brackets each detachably connected to a side of said beam and solely supported thereby; horizontal work surface means mounted on outer sections of said support brackets and supported in cantilever fashion thereby; and enclosure means for mounting said equipment on a side of said work surface means closest to said beam and on inner sections of said support brackets, wherein the top of said support beam mounted on said support legs is no more than two feet above said floor and is substantially below the horizontal plane defined by the top of said work surface means.

10. A work station according to claim 9 wherein said support beam is generally rectangular in transverse cross-section with its long sides, as the beam is viewed in transverse cross-section, extending vertically and the top and sides of said beam are provided with a number of access openings for wiring and cable which can be run through the interior of said beam.

11. A work station according to claim 10 wherein said equipment mounting means comprises a housing for containing said equipment having at least a top panel, a rear panel, a bottom panel detachably connected to the inner sections of said support brackets, and two end walls detachably connected to sides of top panel, rear panel, and bottom panel.

12. A work station suitable for mounting electrical and/or communication equipment comprising a straight, elongate support beam; support legs for mounting said beam in a horizontal position above a floor; support brackets each connected to said beam and extending outwardly from a side thereof, said brackets including arm portions with inner sections that extend outwardly and upwardly and outer sections that extend horizontally and outwardly from top ends of said inner sections, work surface means mounted on said outer sections and forming a flat work surface; and equipment housing means directly mounted on said inner sections of said support brackets, said housing means including a housing member having a top panel located above the plane defined by said work surface, a rear panel, and a bottom panel and removable end walls; said housing member further including means for attaching a similar housing member to one end thereof after removal of one of said end walls from the first mentioned housing member.

13. A work station according to claim 12 wherein said housing means includes two or more housing members connected end to end to form a continuous housing bounded by said end walls at opposite ends and supported from below by said inner sections of said support brackets.

14. A work station according to claim 13 wherein said continuous housing contains rigid vertical dividers connected to the top and bottom panels and spaced apart along the length of the housing.

15. A work station according to claim 12 wherein the bottom panel of the housing member has a number of access openings formed therein adjacent to said rear panel, said acces openings being located directly above said support beam and permitting the introduction of wires and cables into said housing means.

16. A work station suitable for mounting electrical and/or communication equipment comprising a straight, elongate, hollow support beam of generally rectangular cross-section; hollow support legs for mounting said beam in a horizontal position above a floor; said beam having a number of openings in the bottom thereof in which are inserted top end portions of said legs for the support of said beam, the width of said top end portions corresponding closely to the horizontal width of the interior of said beam; means for detachably connecting said top end portions to said beam upon insertion; and support brackets for mounting said equipment on said support beam, said brackets being connected to a side of said beam.

17. A work station acording to claim 16 wherein said support legs include hollow upright portions with open top ends and said beam has a number of access openings in the top thereof which are aligned with the openings in the bottom of said beam whereby wire and cable can be run up the inside of said legs and directly out of said access openings in the top of said beam.

18. A work station suitable for mounting electrical and/or communication equipment comprising a straight, elongate, hollow support beam; a tray section formed on the top of said beam for carrying wiring and/or cables; support legs for mounting said beam in a horizontal position above a floor; said beam having openings in the bottom thereof for insertion of top end portions of said legs into said beam for the support thereof, whereby the top ends of said legs after insertion are below said tray section, means for securing said top ends in said beam, and support brackets for mounting said equipment on said support beam, said brackets being connected to a side of said beam.

19. A work station according to claim 18 wherein said beam is rectangular in cross-section with a horizontal top and has upright flanges extending along the length thereof at the top of the beam, said flanges being located on opposite sides of said beam and forming two sides of said tray section.

20. A work station according to claim 19 wherein said horizontal top has access openings distributed along the length thereof for the passage of wires and/or cables, said access openings are aligned in the vertical direction with said openings in the bottom of said beam, and said support legs are hollow and have open top ends so that wires and/or cables can be run up said legs and into said tray section.

* * * * *